US005896938A

United States Patent [19]

Moeny et al.

[11] Patent Number: 5,896,938

[45] Date of Patent: Apr. 27, 1999

[54] PORTABLE ELECTROHYDRAULIC MINING DRILL

[75] Inventors: William M. Moeny; David M. Barrett, both of Albuquerque, N.M.

[73] Assignee: Tetra Corporation, Albuquerque, N.M.

[21] Appl. No.: 08/757,579

[22] Filed: Nov. 27, 1996

Related U.S. Application Data

[60] Provisional application No. 60/007,872, Dec. 1, 1995.

[51] Int. Cl.[6] ..... E21B 7/00; E21B 7/14

[52] U.S. Cl. ..... 175/1; 175/16; 166/249

[58] Field of Search ..... 175/1, 15, 16, 175/17, 67; 166/249, 65.1, 177.1

[56] References Cited

U.S. PATENT DOCUMENTS

| | | | |
|---|---|---|---|
| 3,700,169 | 10/1972 | Naydan et al. | 239/4 |
| 3,796,463 | 3/1974 | Naydan et al. | 299/14 |
| 3,840,078 | 10/1974 | Allgood et al. | 175/15 |
| 3,881,559 | 5/1975 | Allgood et al. | 175/67 |
| 4,169,503 | 10/1979 | Scott | 166/65.1 |
| 4,479,680 | 10/1984 | Wesley et al. | 299/14 |
| 4,741,405 | 5/1988 | Moeny et al. | 175/16 |
| 5,106,164 | 4/1992 | Kitzinger et al. | 175/16 X |

*Primary Examiner*—Frank S. Tsay

*Attorney, Agent, or Firm*—Deborah A. Peacock; Rod D. Baker

[57] ABSTRACT

An electrohydraulic drilling system for drilling holes in material such as rock utilizing a drill stem connected to a flexible cable. The electrical spark or plasma that creates the electrohydraulic pressure wave is powered by an electrical pulse propagated down the cable from a pulse generator to the drill stem. An advance mechanism on a jackleg support is utilized to move the drill into the rock during the drilling process. The drill stem and cable combination enable holes to be drilled in the roof of tunnels where the floor to roof height is less than the depth of the hole to be drilled. The electrohydraulic process provides higher drilling efficiencies than conventional systems.

71 Claims, 9 Drawing Sheets

PORTABLE ELECTROHYDRAULIC MINING DRILL

CROSS-REFERENCE TO RELATED APPLICATIONS

This application claims the benefit of the filing date of provisional application Ser. No. 60/007,872, entitled Portable Electrohydraulic Mining Drill, filed Dec. 1, 1995, the teachings of which are incorporated herein by reference. This application is also related to U.S. patent applications Ser. No. 60/023,170, entitled Compact, High Efficiency Electrohydraulic Drill and Mining Machine, filed Aug. 5, 1996; Ser. No. 60/011,947, entitled High Power Underwater Plasma Control Methodology for Acoustic and Pressure Pulse Sources, filed Feb. 20, 1996; and Ser. No. 60/023,197, entitled High Power, High Energy Underwater Plasma Electroacoustic Pressure Wave Projector, filed Aug. 5, 1996, the teachings of which are incorporated herein by reference.

BACKGROUND OF THE INVENTION

1. Field of the Invention (Technical Field)

The present invention relates to a portable drill apparatus and system which utilizes the electrohydraulic technique (the creation of shock wave and pressure wave from an underwater spark or plasma) which provides high drilling rates and is useful for the purpose of drilling shallow holes (a few meters in depth) in underground mines and above ground mining and construction applications. The drill utilizes electrical power from an attached pulse generator to create intense shock waves in the electrode area to crush rock or other material. Water flush is provided through the cable and the drill stem to sweep out the cuttings. The drill support and advance mechanism is utilized to advance the drill through the rock.

2. Background Art

One of the ongoing needs for small drills in the mining industry is the drilling of roofbolt holes for supporting the mine roof and the drilling of explosive holes for inserting explosives, removing the ore from the mine face. Conventional drill technology utilizes a star bit and an air hammer to provide drilling action in drilling the holes. These machines are very noisy, the drill tip needs frequent replacement and the overall efficiency of this system is very poor (near 1%). Perhaps, most significantly, the drill cannot be utilized in areas where the distance from the floor to the ceiling is short (of the order of 1–1.5 meters), because of the need to utilize solid rod for the drilling process. The same is true of drills utilizing a rotary motion for the drilling process. In all of these cases, it is not possible for the drill to drill into the roof for a hole depth that is longer than the drill itself. For example, it is not possible for one of these drills operating in a 1.5 meter floor-to-ceiling height to drill a hole in the roof 3 meters deep. In addition, these drills require significant pressure exercised against the rock by the operator in order to provide the cutting action. This places the operator at risk because of the potential fall of rock from the roof onto the operator during the drilling process.

The electrohydraulic process has been used for some period of time for creating shock waves in water (see U.S. Pat. No. 4,471,405, entitled "Focused Shock Spark Discharge Drill Using Multiple Electrodes," to Moeny, et al.). The '405 Patent teaches the use of a pulse forming line to control power flow into the head of a drill utilizing the electrohydraulic process. The pulse forming line is connected to an array of electrodes which forms a spark array. One of the electrodes of each of the array is connected to the high voltage side of the pulse forming line and the other electrodes are at ground potential. When discharged in a liquid, these electrodes produce intense focused shock waves that can pulverize or fracture rock. By delaying the firing of each group of electrodes, the drill can be steered within the earth. Power can be fed to the pulse forming line either downhole or from the surface.

The significant technology issues that must be solved in order to utilize electrohydraulic (EH) rock crushing for drilling in a mining situation include power control to the electrodes, flashover suppression inside the drill, shock wave control, and electrode erosion. Secondly, the electrical pulse that is delivered to the drill must be controlled so that the plasma that is created in the water has the proper relationship of current with time to create the shock wave or pressure wave for efficient and effective crushing of the rock. However, the hardware must then accommodate this pulse so as to provide the high voltage necessary to achieve breakdown at the drill tip without causing breakdown elsewhere in the portable drill stem, especially in the region near but not at the electrodes.

In order to overcome the problems of the prior art, it is necessary to prevent the rock crushing process itself from also crushing the insulator and thus destroying the operation of the drill. Directing the shock wave to the surface to be crushed, and preventing it from crushing key internal portions of the drill is also required for a successful portable electrohydraulic drill. Further, a system to prevent the rock dust from contaminating the insulator thus leading to high voltage flashover across the insulator and destruction of the insulator is needed. All electrohydraulic plasmas erode the electrodes. The physical process is caused by the interaction of the plasma with the molten electrode material. It is unavoidable for practical purposes. Therefore, means to deal with electrode erosion is also required if the electrohydraulic process is to be used for drilling.

SUMMARY OF THE INVENTION (DISCLOSURE OF THE INVENTION)

The present invention is directed to a system which utilizes an electrical spark, or plasma, in water or other incompressible fluid, to create an intense shock wave or pressure wave that crushes the rock or hard material it is directed against. The system comprises a housing incorporating a set of electrodes. The electrical spark or plasma is created by switching a high voltage pulse across two electrodes immersed in the water or fluid. The water or fluid breaks down and a conduction path is formed through the fluid. The current flowing through the conduction path rapidly heats the fluid to steam or vapor and the rapid formation of the vapor creates pressure or shock wave that propagates out from the plasma channel. The shock wave then interacts with the rock or other material to be crushed, transferring its energy to the material, exceeding the strength of the material and crushing or fracturing it.

The present invention includes numerous features to enable a portable drilling machine utilizing the electrohydraulic process. The basic concept is that of a portable drill stem mounted on a flexible cable that connects to a pulse generator which then connects to, or is integral with, a power supply module. A separate drill holder and advance mechanism is utilized to keep the drill pressed up against the rock to facilitate the drilling process. The drill stem is a hard tubular structure of metal or similar hard material that contains the actual plasma generation apparatus and provides current return for the pulse. The stem comprises a set of electrodes at the operating end. These electrodes are typically circular in shape but may be of a convoluted shape for preferential arc management. The electrodes are designed so that an operator can replace them in the field. This very important feature of the subject invention enables the drill to be operated extensively in the mine environment with the high electrode erosion typically generated by high energy, high power operation of underwater plasmas.

Located behind the electrodes in the stem is one or more sets of shock reflectors to reflect the shock wave back into the rock. Part of the shock wave from the plasma propagates to the rock, crushes the rock, and furthers the drilling process. The other part of the shock wave propagates back down inside the drill. If the shock wave were allowed to continue propagating down into the drill it could fracture and damage the insulator. However, the shock reflector reflects that shock wave back into the rock thus contributing to crushing of the rock. Behind the shock reflector lies the insulator. This prevents the electrical pulse from flashing to the outer shell from the inner conductor inside the drill system. Swirl flow is incorporated into the insulator to keep rock dust particles from collecting at the surface of the insulator. The swirl flow is created by a series of water jets in the insulator to pick up rock particles and carry them out the tip of the drill stem.

When the drill is first starting into the rock, some means must be provided to contain the water around the head of the drill so that the shock wave can propagate from the electrodes through bubble-free water onto the rock surface. A boot made of a flexible material such as plastic or rubber is utilized to seal the surface of the drill in the vicinity of the starting point when drilling vertically. The water flow coming up through the insulator and out the tip of the drill then fills the boot and provides the seal until the drill has progressed far enough into the rock to provide its own seal. The boot may either be attached to the tip of the drill with a sliding means so that the boot will slide down over the stem of the drill as the drill progresses into the rock or the boot may be attached to the guide tube of the drill holder so that the drill can progress into the rock and the boot remains attached to the launch tube.

The distance from the tip to the pulse generator represents inductance to the power flow, which stores energy as the current is flowing from the pulse generator to the drill. A special circuit is installed in the pulse generator so that after the main pulse has been transmitted down the cable, then the circuit is shorted so that the pulse energy reflected from the end of the drill is recirculated back up to the drill tip, thus substantially improving the efficiency of the drill while at the same time protecting the capacitors from reverse current.

The cable that carries water and electrical power from the pulse generator to the drill stem is fragile. If a rock should fall on it or it should be run over by a piece of equipment, it would damage the electrical integrity, mash the water line, and impair the performance of the drill. Therefore, this cable must be armored, but in a way that permits flexibility. A flexible armored cable is provided with a corrugated shape. That corrugated shape is utilized as the means for advancing the drill into the hole when the drill hole depth exceeds that of the stem.

There are a number of potential advantages of the compact electrohydraulic drill technology over conventional drills. The first is drilling speed. It is anticipated that the drill could substantially improve the production of holes in a mine. The production drill could incorporate two drills operating out of one pulse generator box with a switch that connects either drill to the pulse generator. In such a scenario, one operator can operate two drills. The operator can be setting up one drill and positioning it while the other drill is in operation. At a drilling rate of 0.5 meters per minute, one operator can drill a one meter deep hole approximately every four minutes with such a set up. Since there is not a requirement for two operators, this dramatically improves productivity and substantially reduces labor cost.

Other advantages of the present invention will become readily apparent to those skilled in the art from the following description which shows and describes a preferred embodiment of the invention, simply by illustrating several of the modes best suited to carry out the invention. As will be realized, the invention is capable of a number of different embodiments and its details are capable of modification in various obvious aspects, all without departing from the scope of the invention. Accordingly, the drawings and description will be regarded as illustrative in nature and not as restrictive.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS (BEST MODES FOR CARRYING OUT OF THE INVENTION)

The present invention provides a technological solution to the major problems with existing small diameter rock drills. A short drill stem length provides the capability of drilling deep holes in the roof of a confined mine space. A flexible cable enables the propagation of the drill into the roof to a depth greater than the floor to roof height. The electrohydraulic process enables high efficiency transfer of energy from electrical storage to shock waves, thus resulting in high overall system efficiency and high drilling rate.

As a general description of the invention, the portable electrohydraulic drill utilizes an electrical plasma in water or a similar fluid to create a strong shock wave. A portable drill stem is mounted on a flexible cable that connects to a pulse generator which then connects to a power supply module. The stem itself is a hollow tube incorporating the insulator, water flush, shock reflectors, and electrodes. The drill stem is a hard tubular structure of metal or similar hard material that contains the actual plasma generation apparatus and provides current return for the electrical pulse. The stem comprises a set of electrodes at the operating end. These electrodes are typically circular in shape but may have a convoluted shape for preferential arc management. The drill tip incorporates replaceable electrodes, which are field replaceable units that can be unscrewed and replaced in the mine. Alternatively, the pulse generator and power supply module can be integrated into one unit. The electrical pulse is created in the pulse generator and then transmitted along the cable to the drill stem. The pulse creates an arc or plasma at the electrodes, thus creating the shock waves. The shock wave propagates through the fluid to the surface of the material, in most cases rock, and crushes the material. Water flow from inside the drill stem sweeps out the crushed material from the hole. The system is intended to be sufficiently compact so that it can be manhandled inside underground mine tunnels. The pulse is designed to provide efficient coupling of electrical power into the rock even in the situation where the drill tip is located some distance from the pulse generator.

Figure 1:
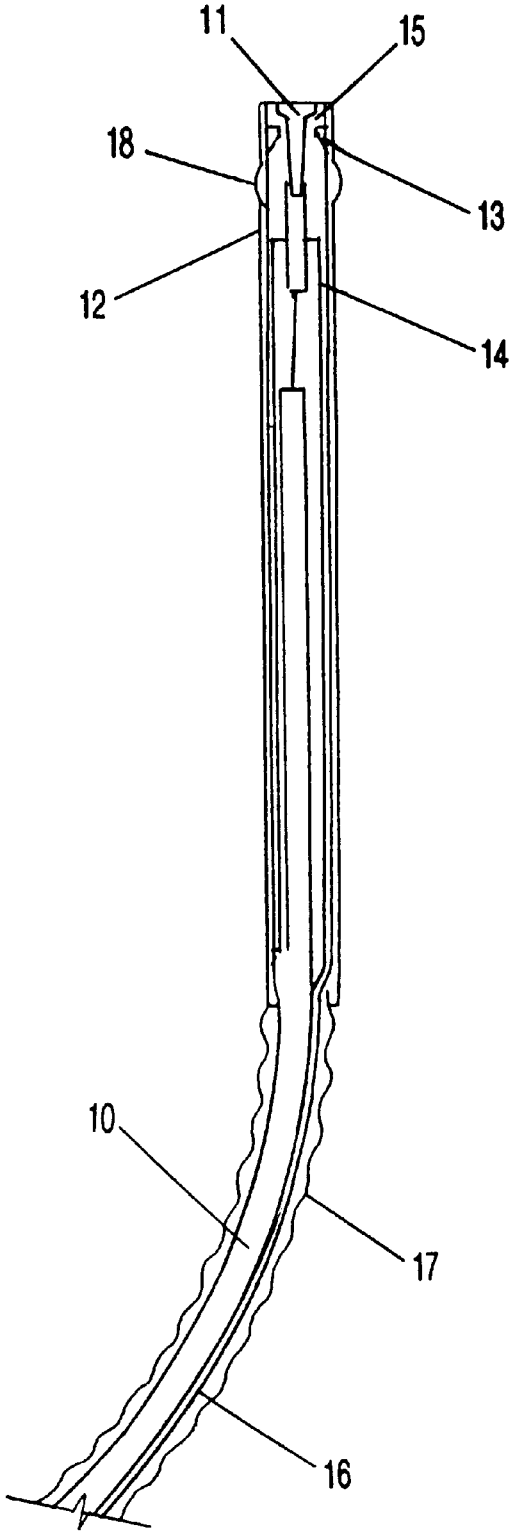
FIG. 1 is a close-up side cutaway view of the portable electrohydraulic drill stem embodiment showing the drill tip replaceable electrodes and shock reflectors.

FIG. 1 shows the basic concept of the drilling stem of a portable electrohydraulic mining drill for drilling in hard rock, concrete or other materials. Pulse cable 10 brings an electrical pulse produced by a pulse modulator (not shown in FIG. 1) to drill tip 11 which is enclosed in drill stem 12. The electrical current creates an electrical arc or plasma in gap 15 between drill tip 11 and drill stem 12 creating a shock wave in water or other fluid. Shock reflector 13 reflects that portion of the shock wave that propagates into stem 12 back through gap 15 to the material being drilled. Water delivery passage 14 in stem 12 feeds water through electrode gap 15 to flush debris out of gap 15. Water passages 14 or other fluid in stem 12 are fed by a water line 16 embedded with pulse cable 10 inside armored jacket 17. Boot holder 18 is disposed on the end of drill stem 12 to hold the boot (not shown in FIG. 1) during the starting of the drilling process. Boot 23 is used to capture water flow coming through gap 15 and supplied by water delivery passage 14 during the starting process. As the drill progresses into the rock or other material, boot 23 slides down stem 12 and down armored jacket 17.

Figure 2:
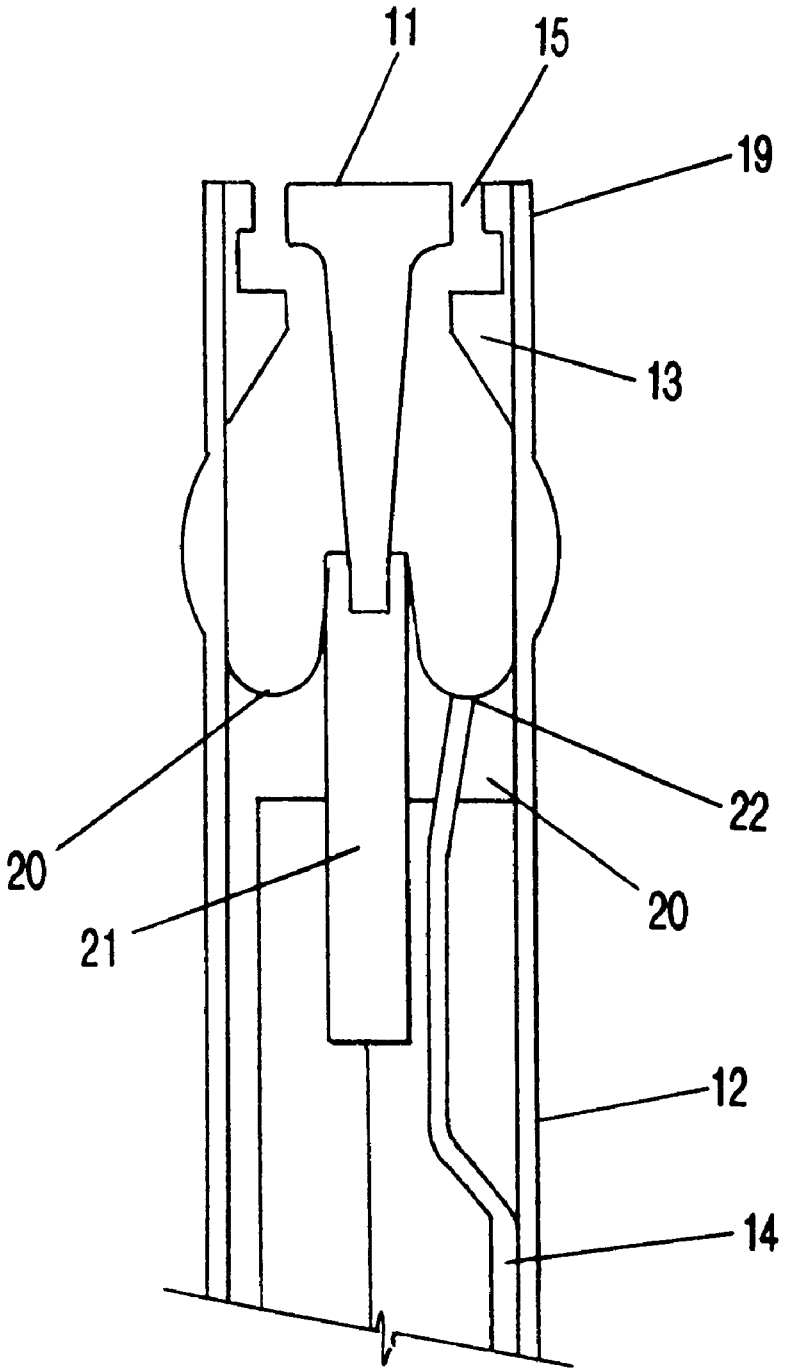
FIG. 2 is a close-up side cutaway view of the drill stem of FIG. 1, incorporating the insulator, water flush, shock reflectors, and electrodes.

FIG. 2 is a closeup view of tip 11 of portable electrohydraulic drill stem 12, showing drill tip 11, discharge gap 15, replaceable outer electrode 19, and shock reflector 13. The electrical pulse is delivered to tip 11. The plasma then forms between tip 11 and replaceable outer electrode 19 in gap 15. The resulting shock wave propagates both forward into the rock and reverse where it meets shock reflector 13, which redirects the shock back through the gap into the rock. A portion of the shock wave propagates past shock reflector 13 and impinges on insulator 20 which separates drill tip holder 21 from drill stem 12. Insulator 20 has water passages 22 built into insulator 20 to flush rock dust out of the base of insulator 20 and through gap 15. The water is provided into insulator 20 section through water delivery line 14.

Figure 3:
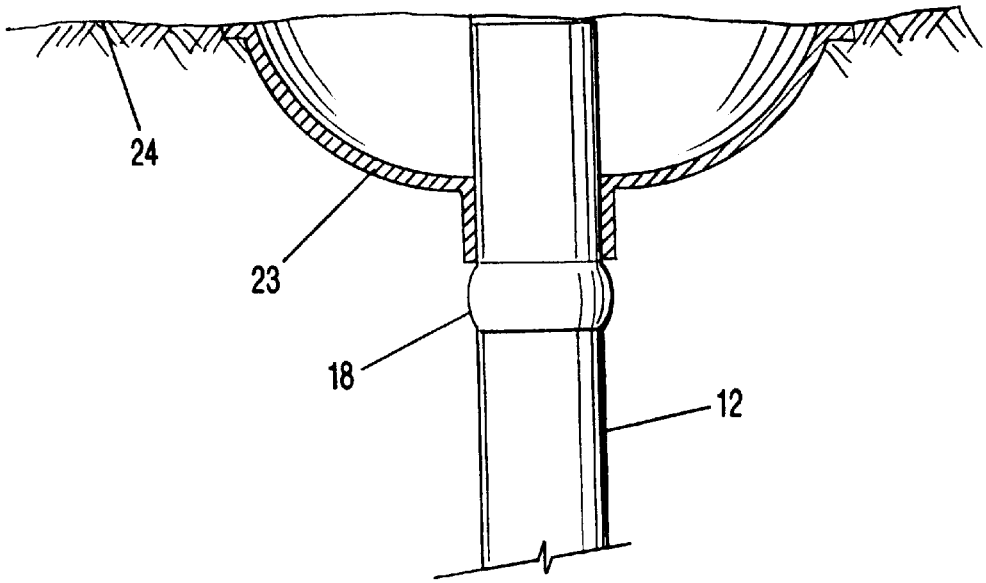
FIG. 3 is a side cutaway view of the preferred boot embodiment of the electrohydraulic drill of the present invention.
Figure 3:
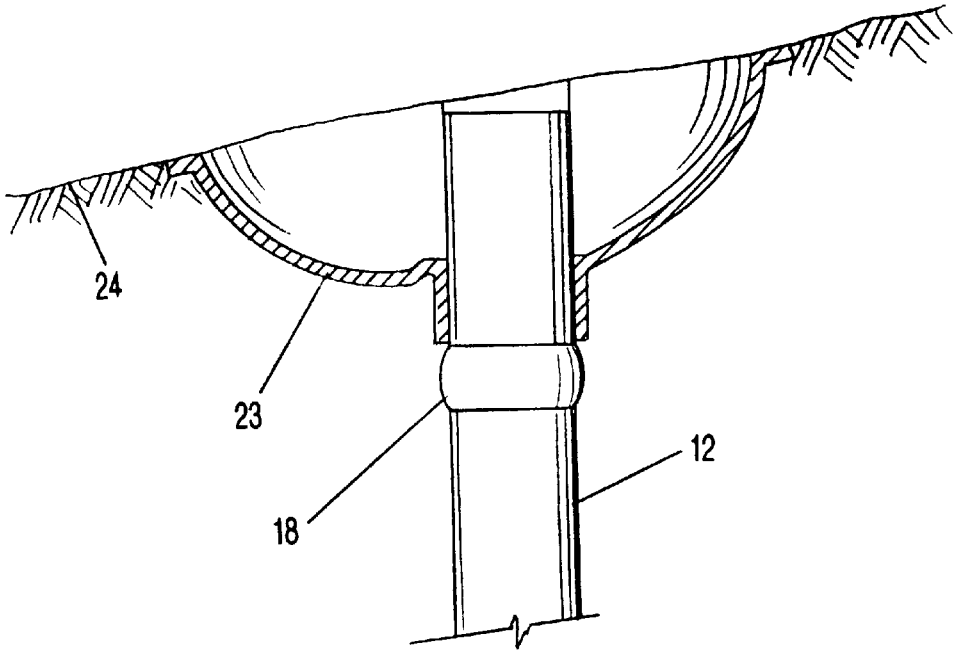

FIG. 3 shows drill stem 12 starting to drill into rock 24. Boot 23 is fitted around drill stem 12, held in place by boot holder 18. Boot 23 provides means of containing the water near rock surface 24, even when drill stem 12 is not perpendicular to rock surface 24 or when rock surface 24 is rough and uneven. As drill stem 12 penetrates into rock 24, boot 23 slides down over boot holder 18.

Figure 4:
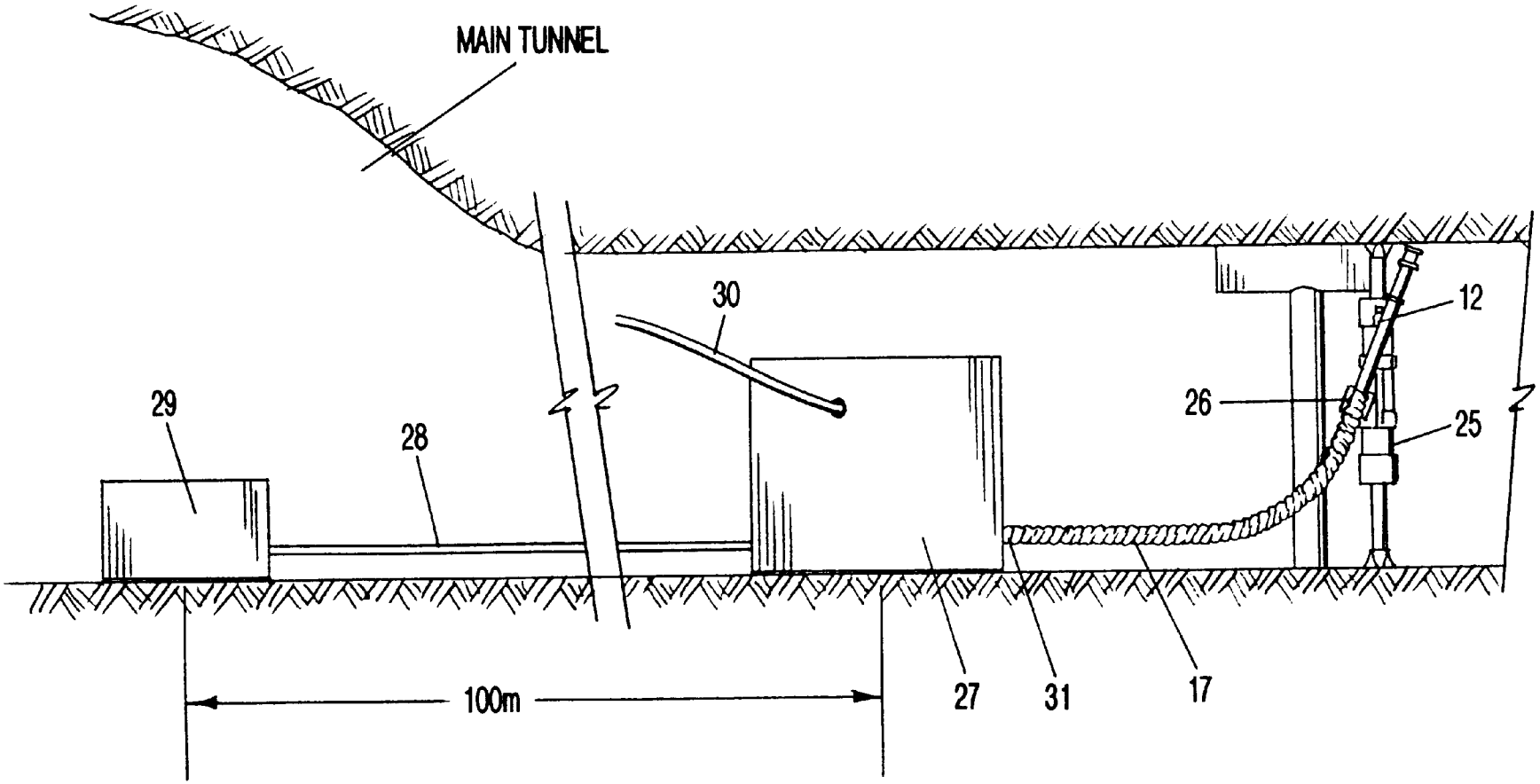
FIG. 4 is a side view of an alternative electrohydraulic mining drill system of the present invention showing a version of the portable electrohydraulic drill in a mine in use to drill holes in the roof for roofbolts.

FIG. 4 shows one embodiment of the portable electrohydraulic mining drill utilizing drill stem 12 described in FIGS. 1–3. Drill stem 12 is shown mounted on jackleg support 25, that supports drill stem 12 and advance mechanism 26. Armored cable 17 connects drill stem 12 to pulse generator 27. Pulse generator 27 is then connected in turn by power cable 28 to power supply 29. Armored cable 17 is typically a few meters long and connects drill stem 12 to pulse generator 27. Armored cable 17 provides adequate flexibility to enable drill stem 12 to be used in areas of low roof height. Power supply 29 can be placed some long distance from pulse generator 27. Water inlet line 30 feeds water to water line 16 (not shown) contained inside armored cable 17. A pressure switch (not shown) may be installed in water line 16 to ensure that the drill does not operate without water flow.

Figure 5:
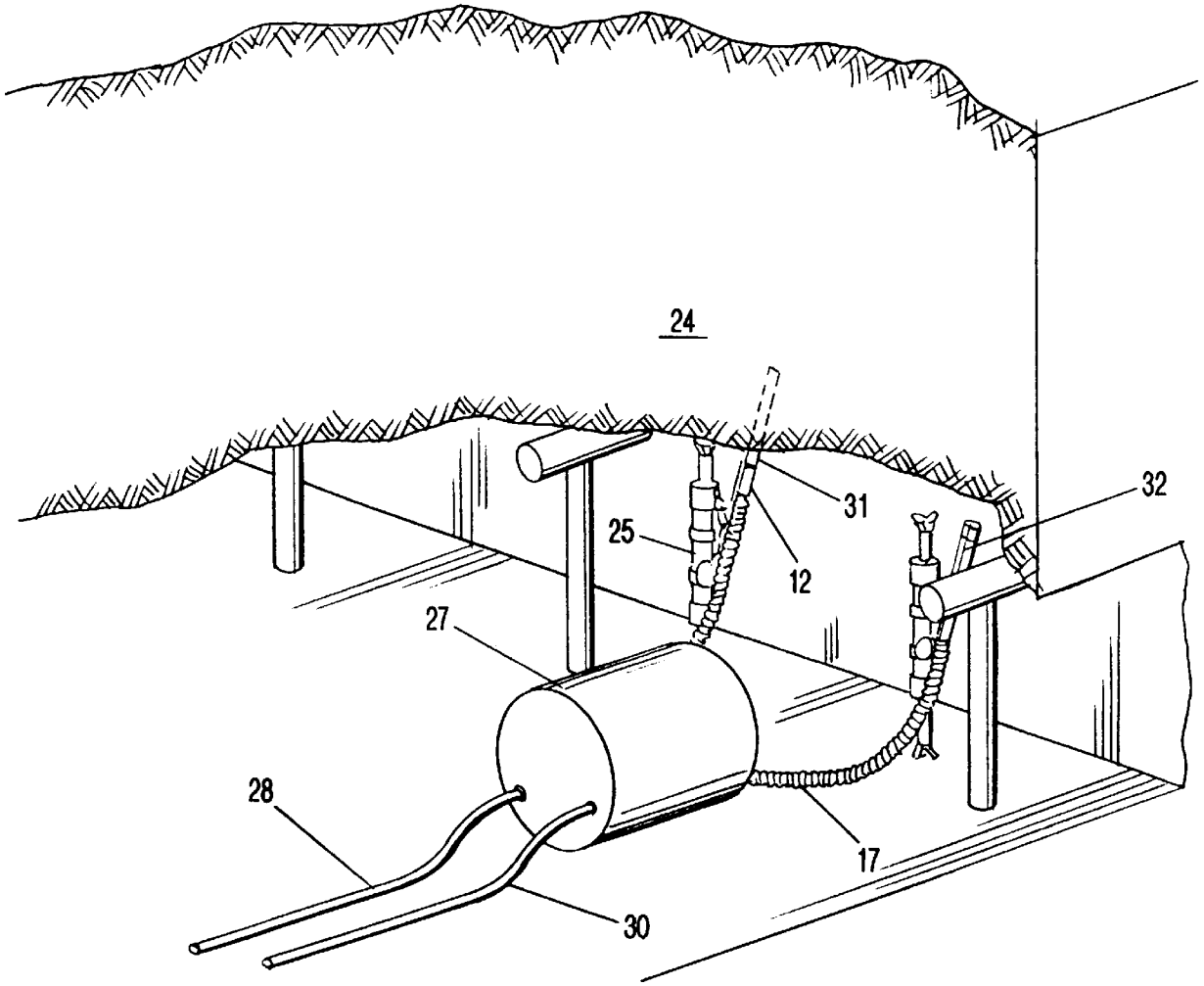
FIG. 5 is a side view of an alternative electrohydraulic mining drill system of the present invention showing a version of the portable electrohydraulic drill to drill holes in the roof for roofbolts. This embodiment comprises two drills capable of non-simultaneous or simultaneous operation from a single pulse generator box.

FIG. 5 shows an embodiment of the subject invention with two drills being operated off single pulse generator 27. This figure shows drill stem 12 of operating drill 31 having progressed some distance into rock 24. Jack leg support 25 provides support for drill stem 12 and provides guidance for drill stem 12 to propagate into rock 24. Pulse generator 27 is shown connected to both drill stems 12. Drill 32 being set up is shown in position, ready to start drilling with its jack leg 25 in place against the roof. Power cable 28, from power supply 29 (not shown in FIG. 5) brings power to pulse generator 27. Water feed line 30 is shown bringing water into pulse generator 27 where it then connects with water line 16 contained in armored cable 17. In this embodiment, while one drill is drilling a hole and being powered by the pulse generator, the second drill is being set up. Thus one man can accomplish the work of two men with this invention.

Figure 6:
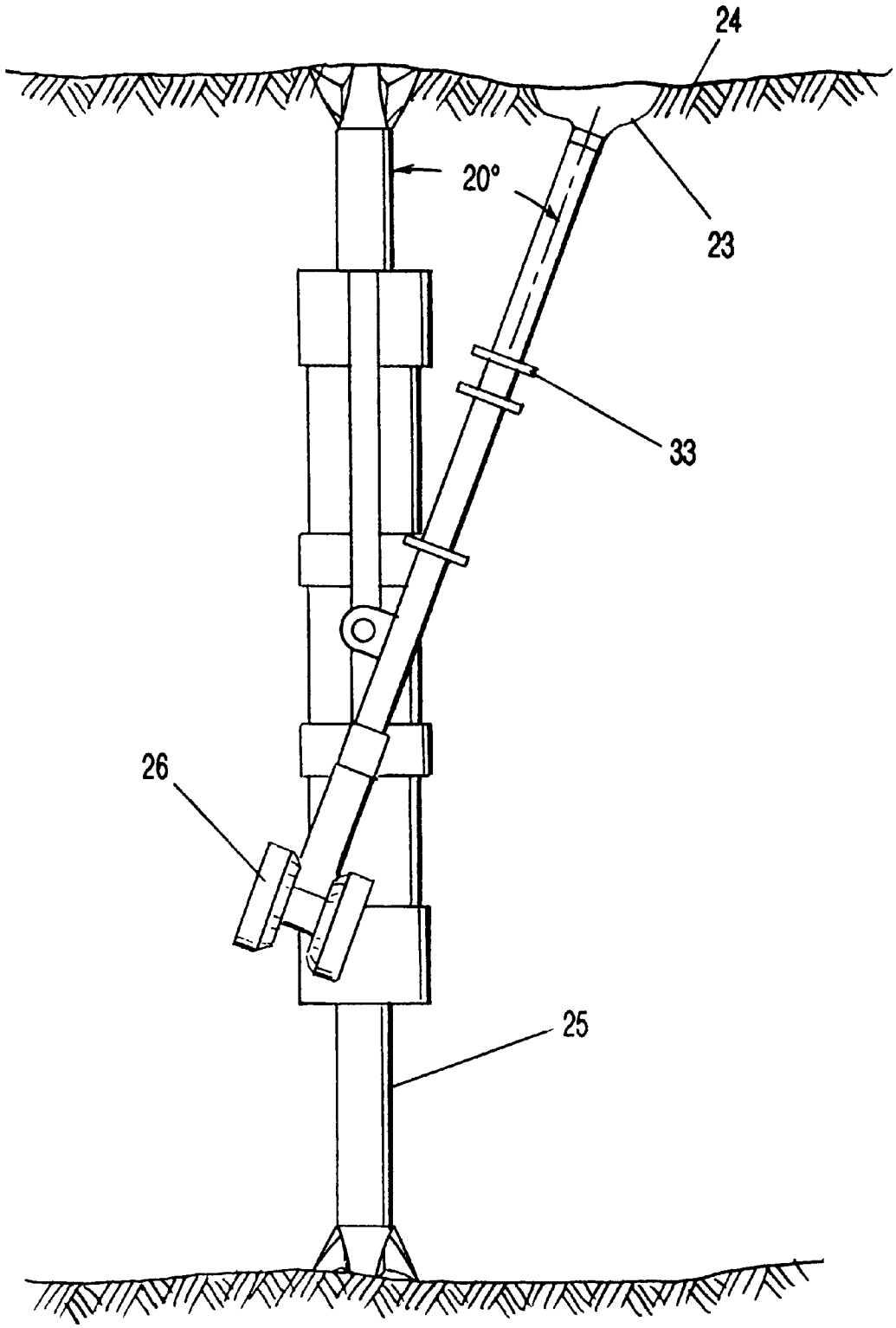
FIG. 6 is a view of the FIG. 1 embodiment of the portable electrohydraulic drill support and advance mechanism.

FIG. 6 shows jack leg support 25 supporting guide structure 33 which guides drill 12 into rock 24. Cradle or tube guide structure 33 holds drill stem 12 and guides it into the drill hole. Guide structure 33 can be tilted at the appropriate angle to provide for the correct angle of the hole in rock 24. Fixed boot 23 can be attached to the end of guide tube 33 as shown in FIG. 6. Advance mechanism 26 grips the serations on armored cable 17 to provide thrust to maintain drill tip 11 in contact with rock 24. Note that advance mechanism 26 does not do the drilling. It is the shock wave created by the underwater plasma that actually does the drilling. Rather, advance mechanisms 26 keeps drill tip 15 and outer electrode 19 in close proximity to rock 24 for efficient drilling. In this embodiment, boot 23 is attached to the uppermost guide loop rather than to drill 12. In this embodiment, drill 12 does not utilize boot holder 18, but rather progresses smoothly through boot 23 into rock 24 guided by the guide loops that direct drill 12.

Figure 7:
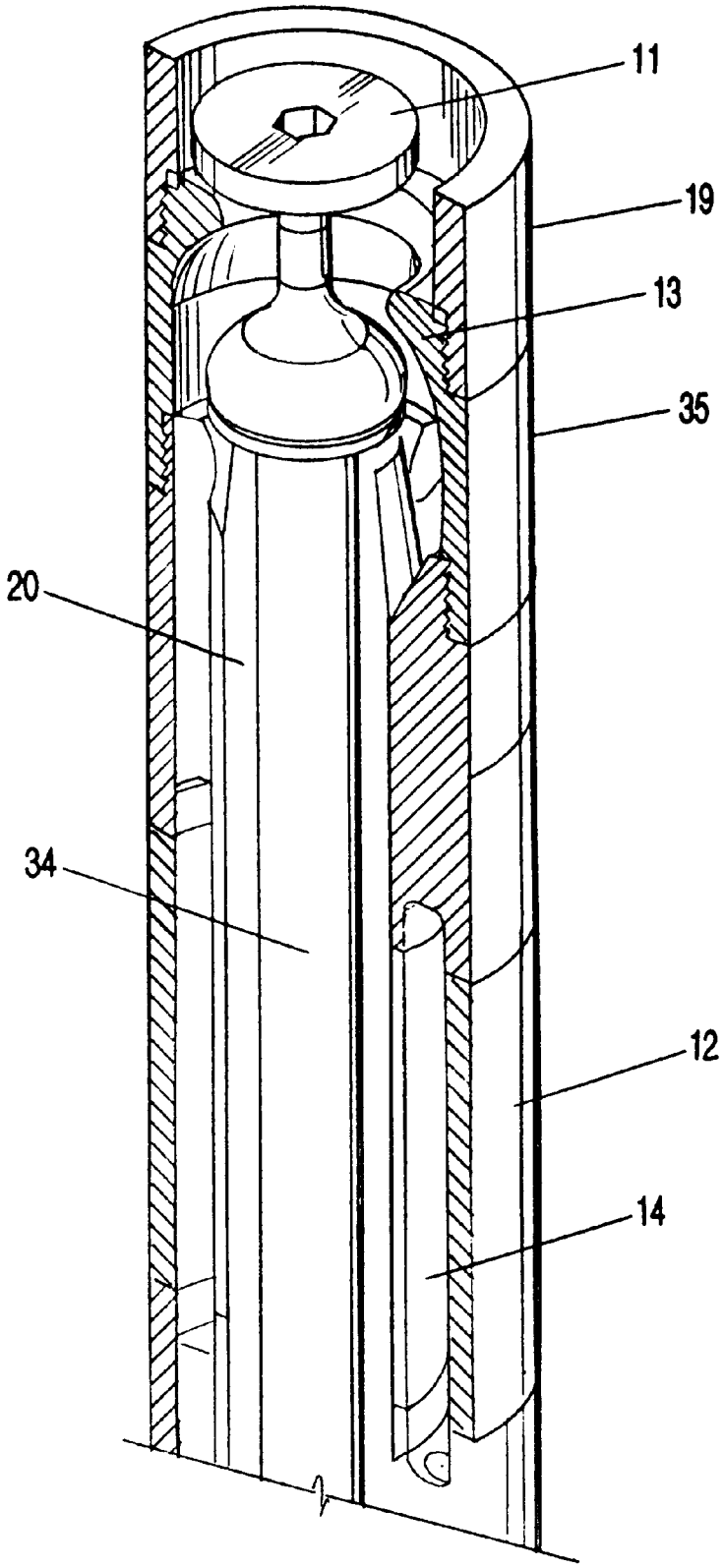
FIG. 7 is a close-up side cut-way view of an alternate embodiment of the drill stem.

FIG. 7 shows a further embodiment wherein the water line is built into drill stem 12 rather than insulator 20. In this embodiment, center conductor 34 provides power from the power source to drill tip 11. Center conductor 34 is surrounded by insulator 20, which then is nested inside drill stem 12 which incorporates water passage 14 inside the stem wall. In this embodiment, drill tip 11 is easily replaceable, outer conductor 19 is easily replaceable, and shock reflector 13 is mounted in replaceable housing 35. An alternative approach is to use slip-in electrodes 19 that are pinned in place. This is a very important feature of the subject invention because it enables the drill to be operated extensively in the mine environment with the high electrode erosion that is typical of high energy, high power operation of underwater plasmas.

Figure 8:
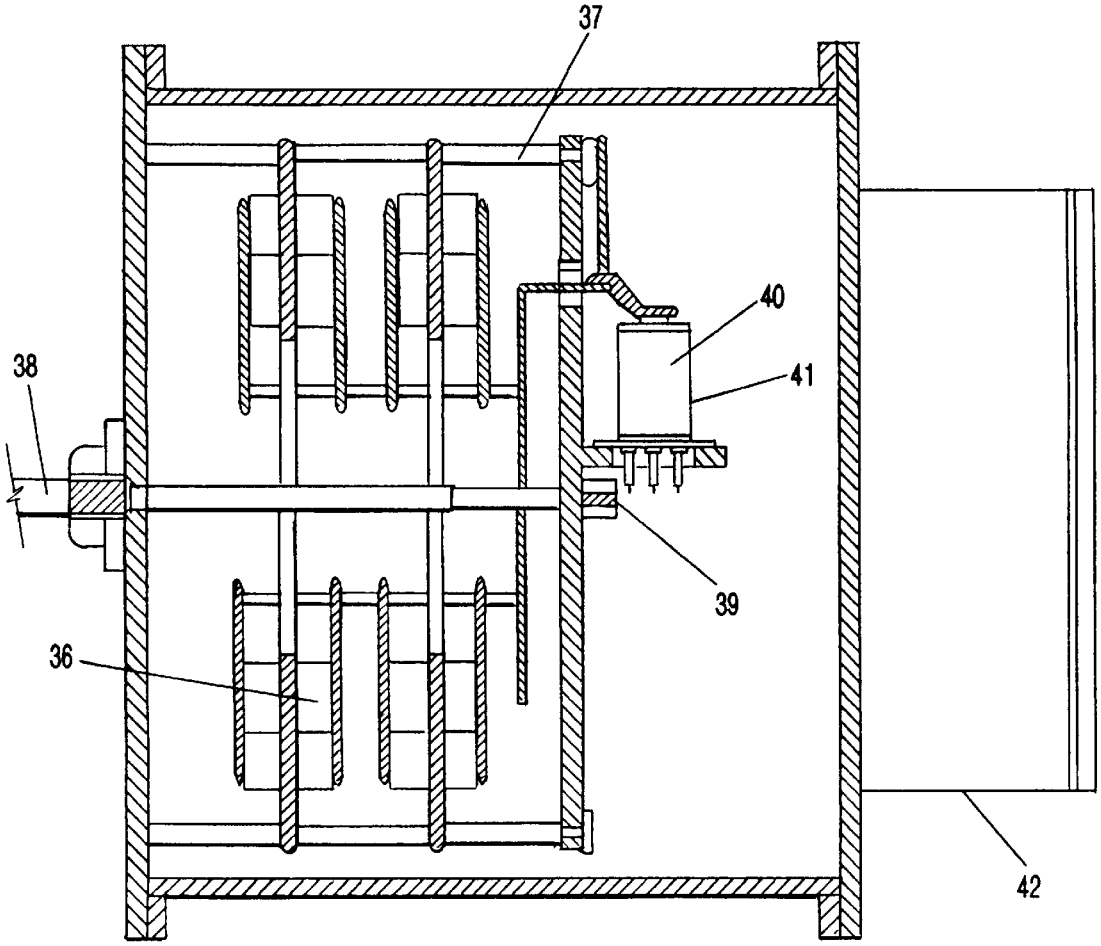
FIG. 8 is a cutaway view of the pulse generator.

FIG. 8 is a cut-away view of pulse generator 27. Capacitors 36 are arrayed on internal frame 37, which then connects to output cable 38, thus providing a robust cable anchor and connection 39. Output cable connection 39 is located near main switch 40 which connects capacitors 36 to cable 17. Clamp switch 41 (behind main switch 40 in FIG. 8) is utilized to enhance power flow into drill stem 12 and prevent oscillation damage to capacitor 36. Control system (not shown) that controls power supply 29, the charging of capacitors 36 and main switching function is located in cabinet 42 fixed to the back of pulse generator box 27. The entire assembly is hermetically sealed and pressurized with a gas to prevent moisture from intruding and upsetting voltage stand off. Alternatively, the assembly can be encapsulated in an appropriate liquid or encapsulant to seal it from the mine environment.

Figure 9:
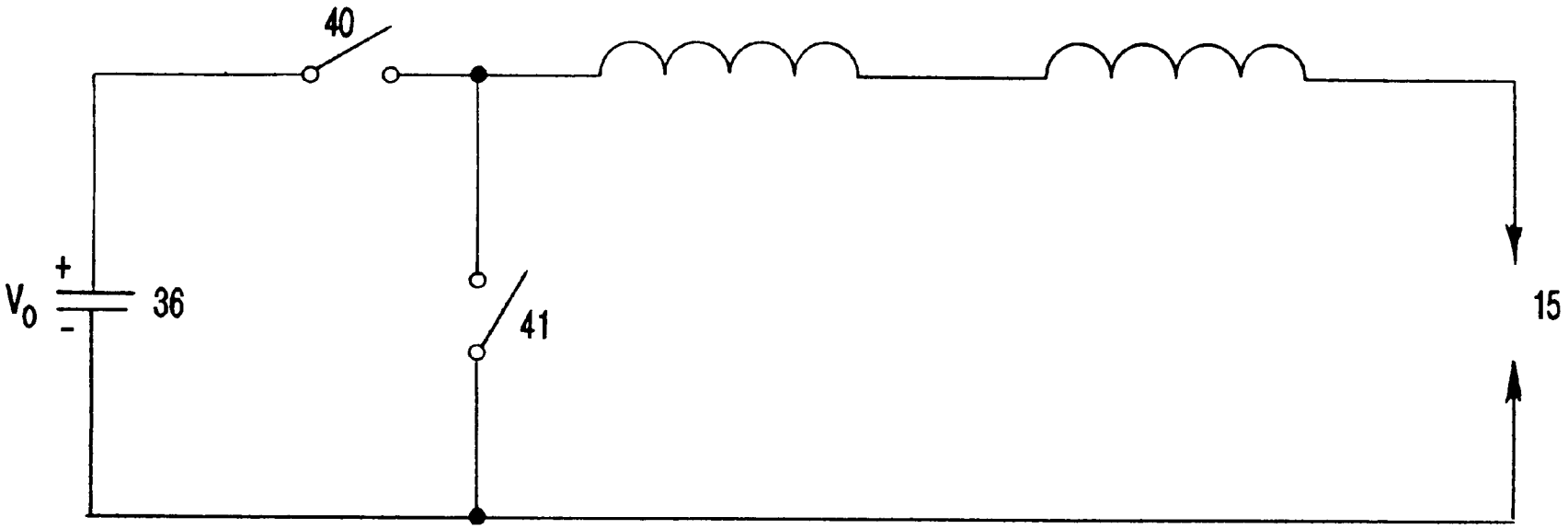
FIG. 9 is a schematic of a special circuit that has been applied and that utilizes a second switch.

A special circuit is incorporated that utilizes a second switch to shunt the current back into cable 10 and hence into drill head 11 bypassing capacitors 36. A schematic of this circuit is shown in FIG. 9. The schematic shows clamp switch 41 that closes on command at some point in time after primary switch 40 has been fired and most of the energy has been propagated down cable 10 into drill stem 12. Closure of second switch 41 then recirculates the current back into cable 17 to gap 15 and thus improves energy transfer to the shock wave. It also improves lifetime of capacitors 36.

The operation of the drill is as follows. The pulse generator is set into a location from which to drill a number of holes. The operator sets up a jack leg and installs the drill in the cradle with the advance mechanism engaging the armored jacket and the boot installed on the tip. The drill is started in its hole at the correct angle by the cradle on the jack leg. The boot has an offset in order to accommodate the angle of the drill to the rock. Once the drill is positioned, the operator goes to the control panel, selects the drill stem to use and pushes the start button which turns on water flow. The drill control system first senses to make sure there is adequate water pressure in the drill. If the drill is not pressed up against the rock, then there will not be adequate water pressure surrounding the drill tips and the drill will not fire. This prevents the operator from engaging the wrong drill and also prevents the drill from firing in the open air when water is not surrounding the drill tip. The drill then starts firing at a repetition rate of several hertz to hundreds of hertz. Upon a fire command from the control system, the primary switch connects the capacitors, which have been already charged by the power supply, to the cable. The electrical pulse is then transmitted down the cable to the electrode tip. The pulse propagates down the cable to the electrodes where the resulting electric field causes the water to break down and causes current to flow across the electrode gap. This flowing current creates a plasma which in turn creates an intense electrohydraulic shock wave. Most, but not all of the pulse energy is absorbed by the plasma. The rest reflects back down the drill stem. The shock wave propagates through the water to the rock and crushes the rock upon impact. The water that is flowing up from the insulators then sweeps the pieces of crushed rock out of the hole. The portion of the shock wave that is not absorbed by the rock reflects from the rock back toward the drill stem. The shock wave then impacts on the drill stem and the shock reflectors and reflects back into the rock again to create further crushing. In addition, that portion of the shock wave resulting from the plasma that propagates down inside the drill impacts the shock reflectors and is reflected back up through the electrode gap onto the rock where it crushes the rock. The water flows in a swirl motion out of the insulator and sweeps up any particles of rock that might have drifted down inside the drill stem and flushes them out the top. After a time delay, such that almost the entire electrical pulse has been delivered to the cable, the shunt switch closes. This causes the reflected electrical pulse to be recirculated back to the electrodes, by-passing the capacitors. When the drill is first starting, the rock particles are forced out under the lip of the boot. When the drill is well into the rock then the rock particles are forced out along the side between the drill and the rock hole. The drill maintains its direction because of its length. The drill should maintain adequate directional control for approximately 4–8 times its length depending on the precision of the hole.

While the first drill is drilling, the operator then sets up the other jack-leg and positions the second drill. Once the first drill has completed drilling, the operator then selects the second drill and starts it drilling. While it is drilling, he moves the first drill to a new location and sets it up to be ready to drill. After several holes have been drilled, the operator will move the pulse generator box to a new location and resume drilling.

The following further summarizes features of the operation of the system of the present invention. An electrical pulse is transmitted down a conductor to a set of removable electrodes where an arc or plasma is created at or between the electrodes that creates a high pressure shock wave which crushes the rock. Water flow passes between the electrodes to flush out particles and maintain cleanliness inside the water cavity in the region of the shock reflectors and the drilling tip. The shock reflectors reflect shock waves forward through the gap that otherwise might propagate backwards into the drill stem and damage the insulator. By making the drill tips easily replaceable, for example, thread-on units, they can be easily replaced in the mine environment to compensate for wear in the electrode gap. The shock reflector protects the insulator from damage from the shock wave and increases the overall crushing efficiency by redirecting the pressure wave forward into the rock. The embedded water channels provide water flow through the drill stem to the drill tip where the water flushes out the rock dust and chips to keep from clogging the interior of the drill stem with chips and keep from shorting the electrical pulse inside the drill stem near the base of the drill tip.

Mine water is drawn into the pulse generator and is used to cool key components through a heat exchanger and is then pumped up the cable water line to the drill stem. Mine water is used to flush the crushed rock out of the hole and maintain water around the drill tip or head. The pulse generator box is hermetically sealed with all of the high voltage switches and cable connections inside the box. The box is pressurized with a gas or filled with a fluid or encapsulated to insulate it. Since the pulse generator is completely sealed, there is no potential of exposing the mine atmosphere to a spark from it. The drill will not operate and power will not be sent to the drill stem unless the water pressure inside the stem is high enough to ensure that the drill tip is completely flooded with water. This will prevent a spark from occurring in air at the drill tip. These two features should prevent any possibility of an open spark in the mine.

There is significant inductance in the circuit between the pulse generator and the drill stem. This is unavoidable because the drill stem must be positioned some distance away from the pulse generator. Normally, such an inductance would create a significant inefficiency in transferring the electrical energy to the plasma and hence to shock wave energy. Because of the inductance, it is difficult to match the equivalent source impedance to the plasma impedance. This is because not all the transmitted electrical energy is absorbed by the drill tip plasma. Thus, part of the energy delivered to the drill tip will reflect back down the cable. This reflected pulse moves from the drill tip down the cable to the capacitors, into the capacitors, where it reflects again, and then back up the drill cable to the tip. This process continues as an oscillation in current until the energy is consumed by the drill tip plasma, the capacitors, and cable losses. This creates excessive stress on the capacitors and causes loss of energy due to equivalent series resistance (ESR) losses in the capacitors. In order to improve the electrical transfer efficiency into the shock wave and avoid this oscillation and its impact on the capacitors, a special circuit has been applied that utilizes a second switch to shunt the current back into the cable and hence into the drill head bypassing the capacitors. Free wheeling diodes can also be used in place of the clamp switch.

By utilizing multiple drills from a single pulse generator, the system is able to increase productivity and reduce manpower cost. The adjustable guide loops on the jack leg enable the drill to feed into the roof at an angle to accommodate the rock stress management and layer orientation in a particular mine.

The same drill can obviously be used for drilling horizontally, or downward. The embodiment of drilling into the roof is shown for illustration purposes and is not intended as a limitation.

The embodiment of the portable electrohydraulic mining drill as shown in FIG. 5, can be utilized to drill holes in the roof of a mine for the insertion of roof bolts to support the roof and prevent injury to the miners. In such an application, one miner can operate the drill, drilling two holes at a rate much faster than a miner could drill one hole with conventional equipment. The miner sets the angle of the jack leg and orients the drill to the roof, feeds the drill stem up through the guide loops and through the boot to the rock with the armored cable engaged in the advance mechanism. The miner then steps back out of the danger zone near the front mining face and starts the drill in operation. The drill advances itself into the roof by the advance mechanisms with the cuttings, or fines, washed out of the hole by the water flow. During this drilling process, the miner then sets up the second drill and orients it to the roof, feeds the drill stem through the boot and the guide loops so that when the first drill is completed, he can then switch the pulse generator over to the second drill and start drilling the second hole.

In a different industrial application, the miner can use the same or similar dual drill set-up to drill horizontal holes into the mine face for inserting explosives to blow the face for recovering the ore.

The application of this drill to subsurface drilling is shown for illustration purposes only. The drill can obviously be used on the surface to drill shallow holes in the ground.

In another embodiment, the pulse generator can operate a plurality of drill stems simultaneously. The operation of two drill stems is shown for illustration purposes only and is not intended to be a limitation.

Another industrial application is the use of the present invention to drill inspection or anchoring holes in concrete structures for anchoring mechanisms or steel structural materials to a concrete structure. Alternatively, such holes drill in concrete structures can also be used for blasting the structure for removing obsolete concrete structures.

There are numerous other applications for the subject portable electrohydraulic mining drill invention not described herein. Most applications requiring the drilling of small holes in hard materials such as rock or concrete will benefit from the present invention.

The invention is further illustrated by the following non-limiting example:

Example (Industrial Applicability)

In one preferred embodiment, the length of the drill stem was fifty cm, with a 5.5 meter long cable connecting it to the pulse modulator to allow operation in a one meter roof height. The drill was designed to go three meters into the roof with a hole diameter of approximately four cm. The drilling rate is 0.5 meters per minute, at fifteen to twenty holes per hour.

The drill system has two drills capable of operation from a single pulse generator. The drill stem is mounted on a holder that locates the drill relative to the roof, maintains the desired drill angle, and provides advance of the drill into the roof so that the operator is not required to hold the drill during the drilling operation. This reduces the operator's exposure to the unstable portion of the mine. While one drill is drilling, the other is being set up, so that one man is able to operate both drills. Both drills connect to the pulse generator at a distance of a few meters. The pulse modulator connects to the power supply which is located one hundred meters or more away from the pulse generator. The power supply connects to the mine power.

The pulse generator is approximately sixty cm long by sixty cm in diameter without roll cage support and protection handles. Mine water is used to cool key components through a heat exchanger and then flows up the cable housing main water line to the drill stem. Mine water is used to flush out the cuttings and maintain water around the drill head. The modulator box is hermetically sealed with all of the high voltage switches and cable connections inside the box. The box is pressurized with an inert gas to insulate it. Since the modulator is completely sealed, there is no potential of spark from it. The drill will not operate and power will not be sent to the drill unless the water pressure inside the stem is high enough to ensure that the drill tip is completely flooded with water. This will prevent a spark from occurring erroneously at the drill tip.

The boot is a stiff rubber piece that fits snugly on the top of the drill support and is used to contain the water for initially starting the drilling process. Once the drill starts to penetrate into the rock, the boot slips over the boot holder bulge and slides on down the shaft. The armored cable is of the same diameter or slightly smaller than the drill stem, and hence the boot will slide down the armored cable as the drill moves up into the drill hole.

The preceding examples can be repeated with similar success by substituting the generically or specifically described reactants and/or operating conditions of this invention for those used in the preceding examples.

Although the invention has been described in detail, with particular reference to these preferred embodiments, other embodiments can achieve the same results. Variations and modifications of the present invention will be obvious to those skilled in the art and it is intended to cover in the appended claims, all such modifications and equivalents.

What is claimed is:

1. A drill which utilizes a spark or plasma within a fluid for creating shock waves or pressure waves to crush or drill material comprising:

a drill tip;

an electrode assembly comprising means for creating a spark or plasma within a fluid at said drill tip and thereby creating a shock wave;

a flexible cable for connecting said electrode assembly to a pulse generator;

fluid flow means for providing flushing fluid to said drill tip; and a drill stem assembly for enclosing and supporting said electrode assembly and providing for directional control of said drill while drilling, wherein said flexible cable comprises a corrugated outer covering for advancing said drill into a hole when a drill hole depth exceeds that of said drill stem.

2. The drill in accordance with claim 1 wherein said drill further comprises an insulator for insulating power feed from said drill stem.

3. The drill in accordance with claim 2 wherein said drill stem comprises jets disposed on said insulator to provide a swirling action across a surface of said insulator to sweep out material particles.

4. The drill in accordance with claim 1 further comprising shock and pressure wave reflectors in said drill stem assembly to enhance efficiency by returning pressure and shock energy to the material being drilled.

5. The drill in accordance with claim 1 further comprising a pressure switch in said drill stem assembly to inhibit operation of said drill unless adequate fluid is flowing through said drill stem assembly to provide adequate pressure for operation.

6. The drill in accordance with claim 1 wherein said electrode assembly comprises a coaxial electrode.

7. The drill in accordance with claim 1 wherein said electrode assembly comprises a replaceable electrode to accommodate high electrode erosion rates.

8. The drill in accordance with claim 1 wherein said electrode assembly comprise a circular shaped electrode.

9. The drill accordance with claim 1 wherein said electrode assembly comprises a convoluted shape electrode.

10. The drill in accordance with claim 1 further comprising a shunt circuit to divert circulating current back into said drill tip to enhance the coupling efficiency of power into the plasma in said drill tip.

11. The drill in accordance with claim 1 further comprising a flexible boot at said drill tip to entrap the fluid and provide a medium for propagating the shock wave to the material during start-up of a drill hole and during the drilling process.

12. The drill in accordance with claim 11, where said flexible boot is attached to a drill holder.

13. The drill in accordance with claim 12 wherein said flexible boot is disposed on an end of said drill holder so that said boot has an angled surface to enable said drill to penetrate into the material at an angle to the material.

14. The drill in accordance with claim 11, wherein said flexible boot is attached to said drill tip.

15. The drill in accordance with claim 14 comprising an angled surface to enable said drill to penetrate into the material at an angle to the material.

16. The drill in accordance with claim 1 further comprising a roller or slide drive corresponding to said flexible cable for providing thrust of said drill into the material.

17. The drill in accordance with claim 1 wherein the pulse generator comprises a sealed pulse generator.

18. The drill in accordance with claim 1 wherein said fluid flow means is disposed in said drill stem assembly.

19. A method for drilling utilizing a spark or plasm within a fluid for creating shock waves or pressure waves to crush or drill material, the method comprising the following steps of:

a) providing a drill comprising a drill tip, an electrode assembly, a cable connected to a pulse generator, and a drill stem assembly;

b) providing fluid at the drill tip;

c) creating a spark or plasma within fluid at the drill tip and thereby creating a shock wave;

d) providing flushing fluid to the drill tip;

e) providing directional control of the drill while drilling via the drill stem assembly; and f) reflecting shock and pressure waves in the drill stem assembly to enhance efficiency by returning pressure and shock energy to the material being drilled.

20. The method of claim 19 further comprising the step of insulating power feed from the drill stem via an insulator.

21. The method of claim 20 further comprising the step of providing a swirling action across a surface of the insulator to sweep out material particles.

22. The method of claim 19 further comprising the step of inhibiting operation of the drill unless adequate fluid is flowing through the drill stem assembly to provide adequate pressure for operation.

23. The method of claim 19 wherein the step of providing electrodes comprises providing disposable and replaceable electrodes to accommodate high electrode erosion rates.

24. The method of claim 19 wherein the step of providing an electrode assembly comprises providing an electrode with a shape to control location of the plasma on the drill tip during the drilling process.

25. The method of claim 19 further comprising the step of diverting circulating current back into the drill tip to enhance the coupling efficiency of power into the plasma in the drill tip.

26. The method of claim 19 further comprising the step of entrapping the fluid at the drill tip during start-up of a drill hole and during the drilling process.

27. The method of claim 19 further comprising the step of propagating the shock wave to the material during start-up of a drill hole and during the drilling process.

28. The method of claim 19 further comprising the step of penetrating the drill into the material at an angle to the material.

29. The method of claim 19 further comprising the step of advancing the drill into a hole when a drill hole depth exceeds that of the drill stem.

30. The method of claim 19 further comprising the step of operating a plurality of drills off a single pulse generator.

31. The method of claim 30 wherein the step of operating a plurality of drills off a single pulse generator comprises operating the drills simultaneously.

32. A drill which utilizes a spark or plasma within a fluid for creating shock waves or pressure waves to crush or drill material comprising:

a drill tip;

an electrode assembly comprising means for creating a spark or plasma within a fluid at said drill tip and thereby creating a shock wave;

a cable for connecting said electrode assembly to a pulse generator;

fluid flow means for providing flushing fluid to said drill tip;

a drill stem assembly for enclosing and supporting said electrode assembly and providing for directional control of said drill while drilling; and shock and pressure wave reflectors in said drill stem assembly to enhance efficiency by returning pressure and shock energy to the material being drilled.

33. The drill in accordance with claim 32 wherein said drill further comprises an insulator for insulating power feed from said drill stem, and said drill stem comprises jets disposed on said insulator to provide a swirling action across a surface of said insulator to sweep out material particles.

34. The drill in accordance with claim 32 wherein said fluid flow means comprises a pressure switch to inhibit operation of said drill unless adequate fluid is flowing through said drill stem assembly to provide adequate pressure for operation.

35. The drill in accordance with claim 32 wherein said electrode assembly comprises a coaxial electrode.

36. The drill in accordance with claim 32 wherein said electrode assembly comprises a replaceable electrode to accommodate high electrode erosion rates.

37. The drill in accordance with claim 32 wherein said electrode assembly comprise a circular shaped electrode.

38. The drill accordance with claim 32 wherein said electrode assembly comprises a convoluted shape electrode.

39. The drill in accordance with claim 32 further comprising a shunt circuit to divert circulating current back into said drill tip to enhance the coupling efficiency of power into the plasma in said drill tip.

40. The drill in accordance with claim 32 further comprising a flexible boot at said drill tip to entrap the fluid and provide a medium for propagating the shock wave to the material during start-up of a drill hole and during the drilling process.

41. The drill in accordance with claim 40 where said flexible boot is attached to a drill holder.

42. The drill in accordance with claim 40 wherein said flexible boot is attached to said drill tip.

43. The drill in accordance with claim 32 wherein said cable comprises a flexible cable comprising a corrugated outer covering for advancing said drill into a hole when a drill hole depth exceeds that of said drill stem.

44. The drill in accordance with claim 43 further comprising a roller or slide drive corresponding to said flexible cable for providing thrust of said drill into the material.

45. The drill in accordance with claim 32 wherein the pulse generator comprises a sealed pulse generator.

46. The drill in accordance with claim 32 wherein said fluid flow means is disposed in said drill stem assembly.

47. A drill which utilizes a spark or plasma within a fluid for creating shock waves or pressure waves to crush or drill material comprising:

a drill tip;

an electrode assembly comprising means for creating a spark or plasma within a fluid at said drill tip and thereby creating a shock wave;

a cable for connecting said electrode assembly to a pulse generator;

fluid flow means for providing flushing fluid to said drill tip;

a drill stem assembly for enclosing and supporting said electrode assembly and providing for directional control of said drill while drilling; and a pressure switch in said drill stem assembly to inhibit operation of said drill unless adequate fluid is flowing through said drill stem assembly to provide adequate pressure for operation.

48. The drill in accordance with claim 47 wherein said drill further comprises an insulator for insulating power feed from said drill stem, and said drill stem comprises jets disposed on said insulator to provide a swirling action across a surface of said insulator to sweep out material particles.

49. The drill in accordance with claim 47 further comprising shock and pressure wave reflectors in said drill stem assembly to enhance efficiency by returning pressure and shock energy to the material being drilled.

50. The drill in accordance with claim 47 wherein said electrode assembly comprises a coaxial electrode.

51. The drill in accordance with claim 47 wherein said electrode assembly comprises a replaceable electrode to accommodate high electrode erosion rates.

52. The drill accordance with claim 47 wherein said electrode assembly comprises a convoluted shape electrode.

53. The drill in accordance with claim 47 further comprising a shunt circuit to divert circulating current back into said drill tip to enhance the coupling efficiency of power into the plasma in said drill tip.

54. The drill in accordance with claim 47 further comprising a flexible boot at said drill tip to entrap the fluid and provide a medium for propagating the shock wave to the material during start-up of a drill hole and during the drilling process.

55. The drill in accordance with claim 54 where said flexible boot is attached to a drill holder.

56. The drill in accordance with claim 54 wherein said flexible boot is attached to said drill tip.

57. The drill in accordance with claim 47 wherein said cable comprises a flexible cable comprising a corrugated outer covering for advancing said drill into a hole when a drill hole depth exceeds that of said drill stem.

58. The drill in accordance with claim 47 wherein the pulse generator comprises a sealed pulse generator.

59. The drill in accordance with claim 47 wherein said fluid flow means is disposed in said drill stem assembly.

60. A drill which utilizes a spark or plasma within a fluid for creating shock waves or pressure waves to crush or drill material comprising:

a drill tip;

an electrode assembly comprising means for creating a spark or plasma within a fluid at said drill tip and thereby creating a shock wave;

a cable for connecting said electrode assembly to a pulse generator;

fluid flow means for providing flushing fluid to said drill tip;

a drill stem assembly for enclosing and supporting said electrode assembly and providing for directional control of said drill while drilling; and a flexible boot at said drill tip to entrap the fluid and provide a medium for propagating the shock wave to the material during start-up of a drill hole and during the drilling process.

61. The drill in accordance with claim 60 where said flexible boot is attached to a drill holder.

62. The drill in accordance with claim 60 wherein said flexible boot is attached to said drill tip.

63. The drill in accordance with claim 62 comprising an angled surface to enable said drill to penetrate into the material at an angle to the material.

64. The drill in accordance with claim 61 wherein said flexible boot is disposed on an end of said drill holder so that said boot has an angled surface to enable said drill to penetrate into the material at an angle to the material.

65. The drill in accordance with claim 60 wherein said drill further comprises an insulator for insulating power feed from said drill stem, and said drill stem comprises jets disposed on said insulator to provide a swirling action across a surface of said insulator to sweep out material particles.

66. The drill in accordance with claim 60 further comprising shock and pressure wave reflectors in said drill stem assembly to enhance efficiency by returning pressure and shock energy to the material being drilled.

67. The drill in accordance with claim 60 wherein said fluid flow means comprises a pressure switch to inhibit operation of said drill unless adequate fluid is flowing through said drill stem assembly to provide adequate pressure for operation.

68. The drill in accordance with claim 60 wherein said electrode assembly comprises a replaceable electrode to accommodate high electrode erosion rates.

69. The drill accordance with claim 60 wherein said electrode assembly comprises a convoluted shape electrode.

70. The drill in accordance with claim 60 wherein said cable comprises a flexible cable comprising a corrugated outer covering for advancing said drill into a hole when a drill hole depth exceeds that of said drill stem.

71. The drill in accordance with claim 70 further comprising a roller or slide drive corresponding to said flexible cable for providing thrust of said drill into the material.

* * * * *